US006650596B2

(12) United States Patent
Kumhyr et al.

(10) Patent No.: US 6,650,596 B2
(45) Date of Patent: Nov. 18, 2003

(54) METHOD OF CALCULATING RELIGIOUS HIJRI CALENDAR

(75) Inventors: David Bruce Kumhyr, Austin, TX (US); Samer Farid Najjar, Austin, TX (US); Dalal Fathy Younis, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 392 days.

(21) Appl. No.: 09/815,544

(22) Filed: Mar. 22, 2001

(65) Prior Publication Data

US 2002/0136093 A1 Sep. 26, 2002

(51) Int. Cl.[7] ..... G04B 19/26; G04B 19/24

(52) U.S. Cl. ..... 368/15; 308/28; 708/112

(58) Field of Search ..... 368/10, 15–18, 368/28; 708/111–112

(56) References Cited

U.S. PATENT DOCUMENTS 4,253,169 A * 2/1981 Salah ..... 368/15
4,659,231 A * 4/1987 Barkouki ..... 368/15
6,272,076 B1 * 8/2001 Dinger ..... 368/15

* cited by examiner

*Primary Examiner*—Vit Miska
(74) *Attorney, Agent, or Firm*—Carr LLP; Robert M. Carwell

(57) ABSTRACT

A method for calculating a Hijri religious calendar based on the visibility of a crescent moon. The method comprises using a camera and/or weather reports to determine the weather conditions in a region. Preferably, the camera view and the weather report are available via the Internet.

36 Claims, 4 Drawing Sheets

200
210
INITIATE REQUEST
212
CALC RELIGIOUS HIJRI CALENDAR?
NO
214
CALCULATE CIVIL HIJRI CALENDAR
YES
216
MOON IN POSITION AT SUNSET ON 29TH DAY?
NO
YES
218
MOON VISIBLE AT SUNSET?
YES
NO
220
CALCULATE NEW MONTH
222
CALCULATE 30-DAY MONTH
299
END

METHOD OF CALCULATING RELIGIOUS HIJRI CALENDAR

BACKGROUND OF THE INVENTION

1. Field of the Invention

The invention relates generally to a method of determining lunar-based events and, more particularly, to a method of determining an Islamic Hijri religious calendar.

2. Description of the Related Art

Many events, such as the Islamic religious Hijri calendar, are based upon actual lunar observations. The religious Hijri calendar year comprises twelve lunar months, each month comprising of 29 or 30 days, beginning at sunset on the day of a visual sighting of a lunar crescent. If the lunar crescent is visible at sunset of the $29^{th}$ day, a new month begins, resulting in a month of 29 days. If the lunar crescent is not visible at sunset of the $29^{th}$ day, however, the current month continues for one additional day, resulting in a month of 30 days. As a result, the religious Hijri calendar may not be accurately calculated in advance.

The visual sighting of the lunar crescent depends on the position of the moon relative to a geographic location and the weather conditions, among others. The position of the moon relative to a geographic location of an observer provides an indication of when the lunar crescent will be visible above the Earth's horizon. The ability to calculate the position of the moon relative to a geographic location, such as a latitude and longitude, is well known to a person of ordinary skill in the art.

The second factor, however, is dependent upon the visibility of the lunar crescent at a specific location. The visibility of the lunar crescent depends upon the weather conditions, among other things, which may not be accurately forecasted to allow the creation of the religious Hijri calendar in advance.

Prior attempts to determine the religious Hijri calendar are not accurate. One attempt, also referred to as the civil Hijri calendar, comprises calculating the lunar position relative to a given location, such as the latitude and longitude. This method, however, does not consider weather conditions that may affect the actual visibility of the lunar crescent. As a result, this method may falsely indicate the start of a month.

Another attempt to determine the religious Hijri calendar comprises observing and announcing the visibility of the moon on a regional basis, such as by a country. This method, however, does not consider the weather conditions in various parts of the country and, as a result, may again falsely indicate the start of a month for some parts of the region.

Therefore, there is a need for calculating the religious Hijri calendar taking into consideration the visibility of the lunar crescent.

SUMMARY OF THE INVENTION

The present invention comprises a method and an apparatus for calculating the beginning of a new lunar month by providing a user with web observation of the sky in the direction of the moon for the purpose of determining whether the moon is visible. Alternatively, a weather report may also be accessed to determine if the weather conditions are suitable for viewing the moon. Upon a determination that the moon is visible, the beginning of the new lunar month is indicated. If, however, a determination is made that the moon is not visible, then the lunar month continues for another day.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION

Figure 1:
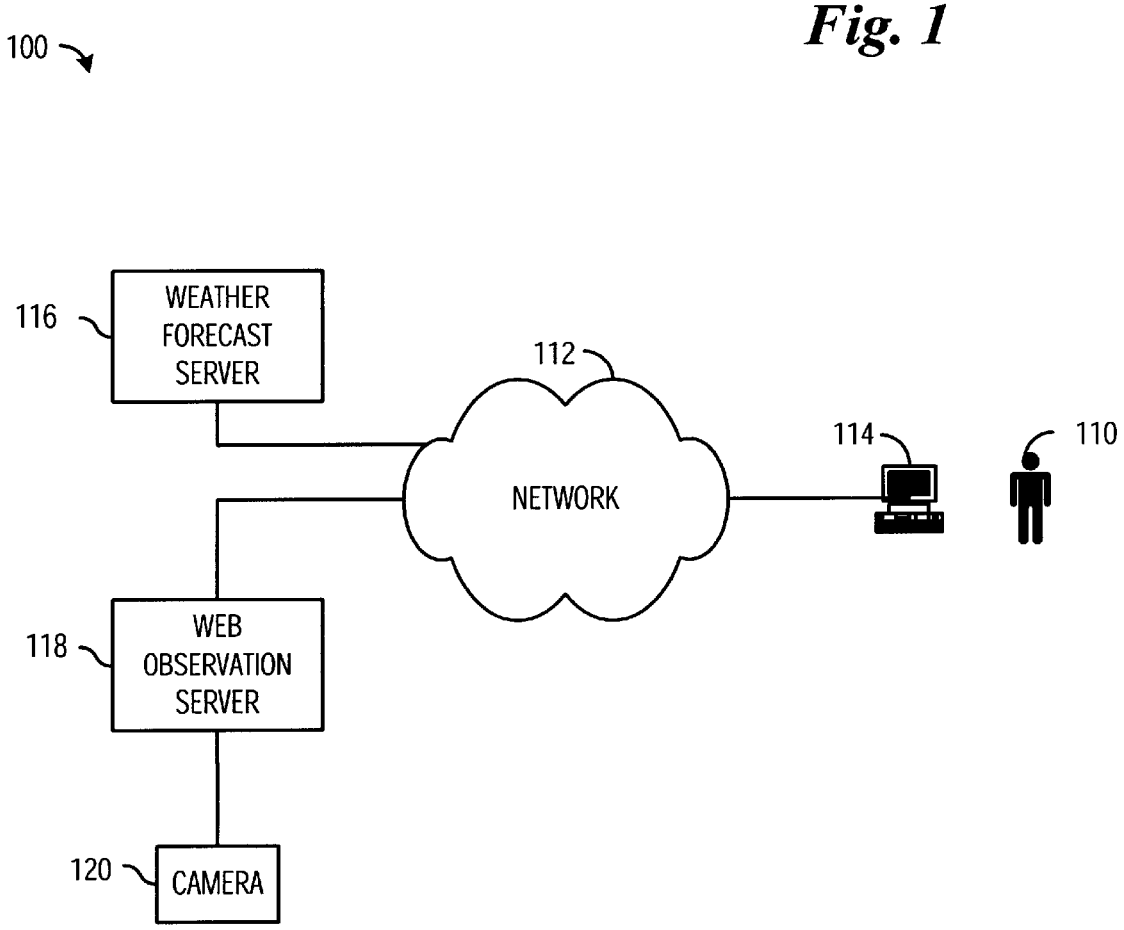
FIG. 1 schematically depicts a network environment that embodies the present invention.

Referring to FIG. 1 of the drawings, the reference numeral 100 generally designates a system embodying features of the present invention. The system 100 comprises a user 110 accessing a network 112, such as the Internet and the like, via an access device 114, such as workstation, cell phone, PDA, and the like. One or more service providers, such as a weather forecast server 116, a web observation server 118, and the like, are connected to the network 112. The weather forecast server 116 is configured for providing the user 110 access to weather reports and forecasts. A camera 120 is preferably coupled to the web observation server 118 and is preferably positioned to provide a view of the sky in the direction of where the moon is expected. As discussed in further detail below with respect to FIGS. 2–3B, the user 110 is enabled, via the access device 114 and the network 112, to access the weather forecast server 116 and the web observation server 118. The user 110 utilizes the weather report and/or forecast from the weather forecast server 116 and/or the view from the camera 120 coupled to the web observation server 118 to determine the visibility of the moon. If a determination is made that the moon is visible, a new month begins. If a determination is made that the moon is not visible, the current month continues for one additional day.

Figure 2:
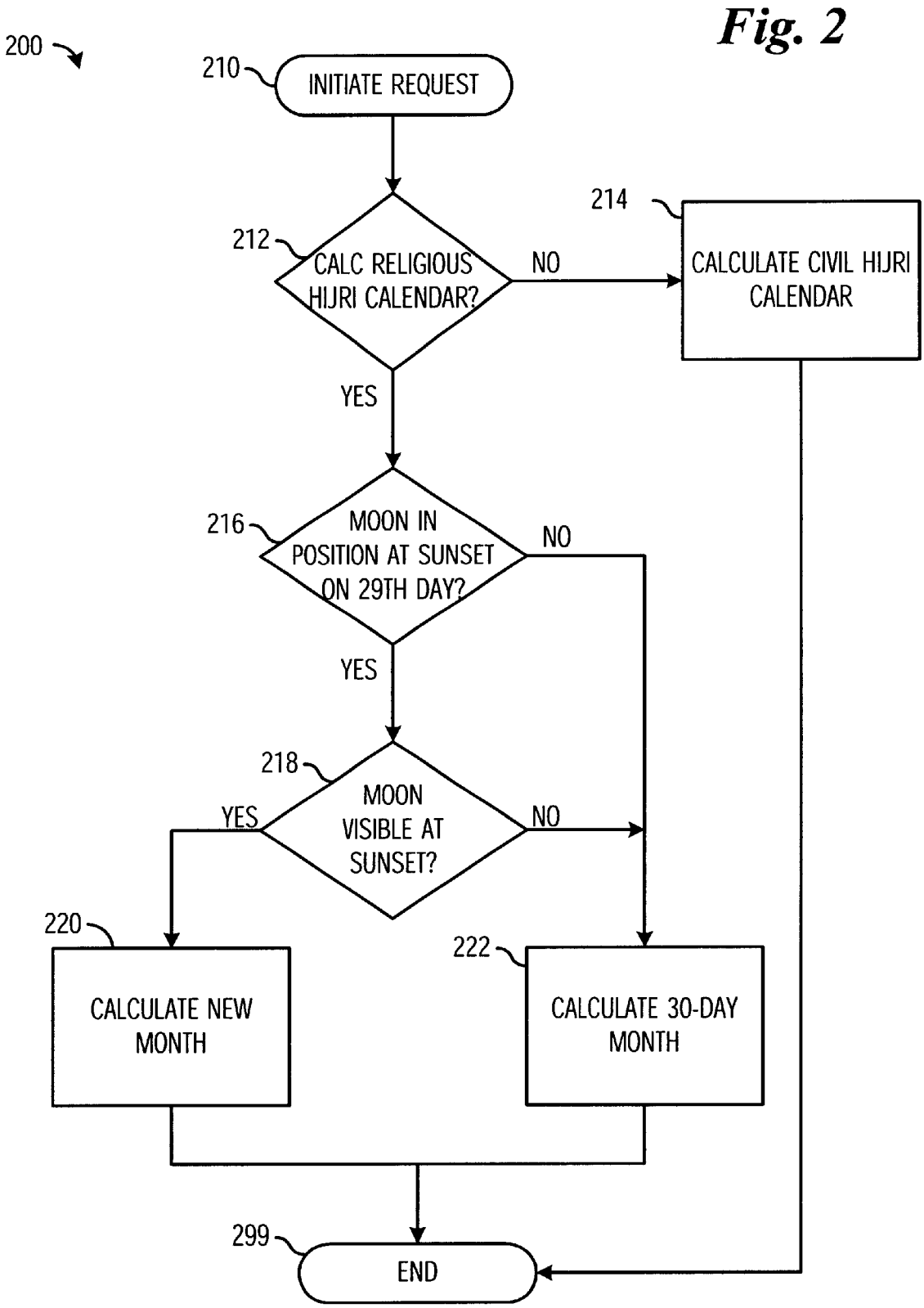
FIG. 2 is a flow chart illustrating one embodiment of the present invention in which a religious Hijri calendar is determined.

Referring now to FIG. 2 of the drawings, reference numeral 200 illustrates a flow chart in which the religious and civil Hijri calendars are calculated. The illustrated process preferably executes as an interactive process accessible via the network 112. The process assumes that the position of the moon in the sky has been calculated previously and fulfills the requirements for the beginning of a new month. The process of calculating the position of the moon in the sky is well known in the art and, therefore, will not be discussed in greater detail.

The process begins when a user 110 initiates a request for a Hijri calendar 210. In the first step 212, a determination is made whether a religious Hijri calendar or a civil Hijri calendar is being requested. If it is determined that a civil Hijri calendar is requested, then execution proceeds to step 214, wherein the civil Hijri calendar is calculated. While the religious Hijri calendar typically depends on the visibility of the moon at any given location, the civil Hijri calendar is based on astronomical tables, allowing for a common date to be used among various locations and the accurate setting of a calendar in advance. A central body, such as the King Saud University in Saudi Arabia, generally calculates the civil Hijri calendar, commonly referred to as the Um Al-Qura calendar. The creation and use of the civil Hijri calendar is well known to a person of ordinary skill in the art and, therefore, will not be discussed in greater detail. Upon completion of the civil Hijri calendar in step 214, the process terminates, as indicated in step 299. If, in step 212, it is determined that the religious Hijri calendar is requested, then execution proceeds to step 216, wherein a determination is made whether the lunar crescent is in position for visibility at sunset on the $29^{th}$ day of the month. The start of a new month is dependent on the visual sighting of the lunar crescent on the $29^{th}$ day of the month at sunset. If the moon is observed, then a new month begins, otherwise, the month continues for one additional day, after which a new month begins.

Preferably, the position of the lunar crescent at sunset is determined by, among other things, the moon's altitude above the horizon at sunset and the relative azimuth of the moon from the sun at sunset. The method of determining the position of the lunar crescent at sunset, such as the computer program entitled "MoonCalc" by Dr. Monzur Ahmed, is well known to a person of ordinary skill in the art and, therefore, will not be discussed in greater detail.

If, in step 216, it is determined that the lunar crescent is in position for visibility at sunset, then execution proceeds to step 218, wherein a determination is made whether the lunar crescent is visible (as discussed further below with respect to FIGS. 3A and 3B). If it is determined that the lunar crescent is visible, then in step 220 a new month is calculated, resulting in a 29-day month. If, however, it is determined in step 218 that the lunar crescent is not visible, then in step 222 the current month continues for one additional day, resulting in a 30-day month. The method of calculating a month given a date by which to begin calculations, such as the start of a month and/or the last day of the month, is well known to a person of ordinary skill in the art and, therefore, will not be discussed in greater detail.

Figure 3A:
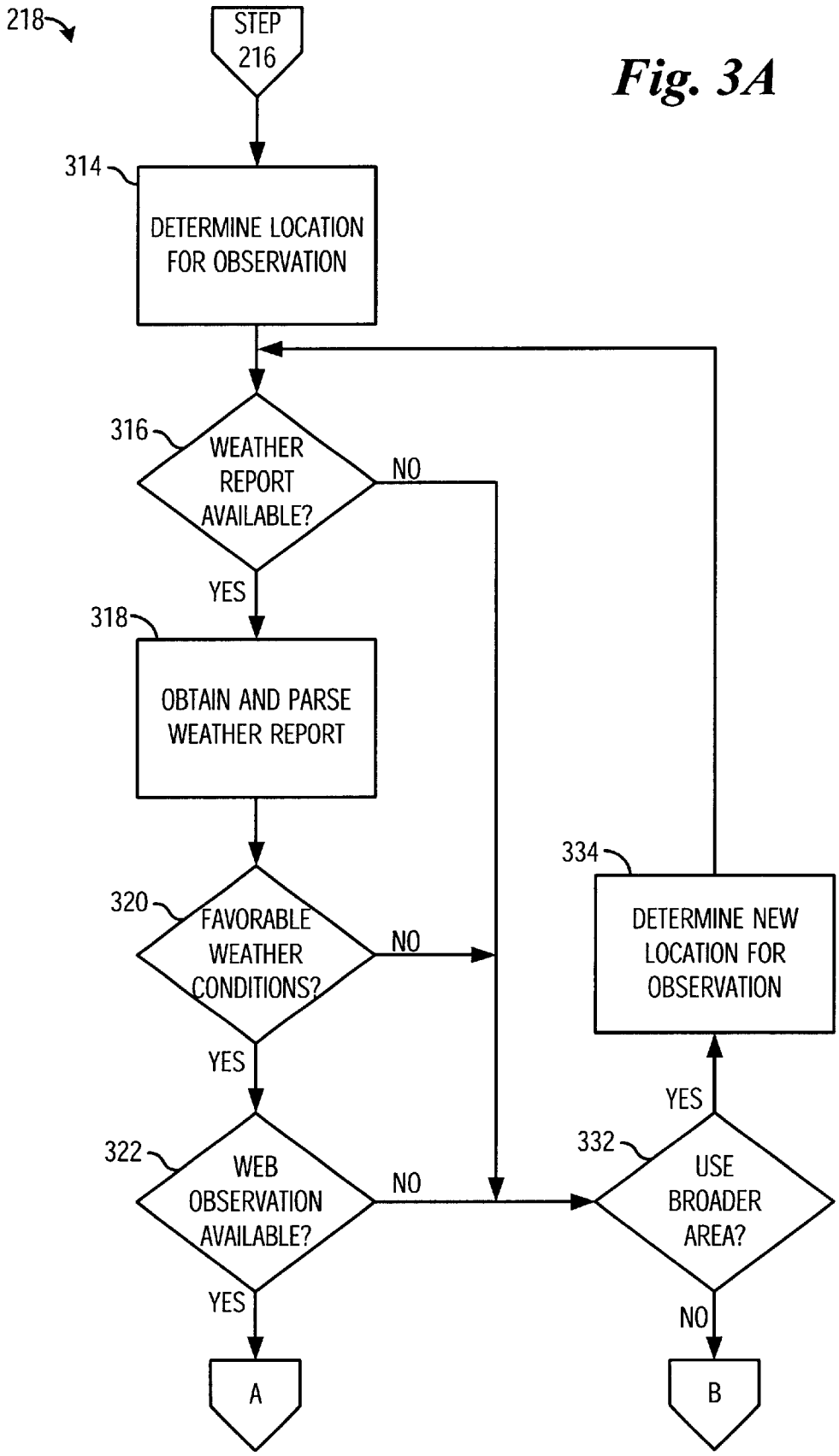
FIGS. 3A and 3B are flow charts illustrating one embodiment of the present invention in which visibility of the lunar crescent is determined.
Figure 3B:
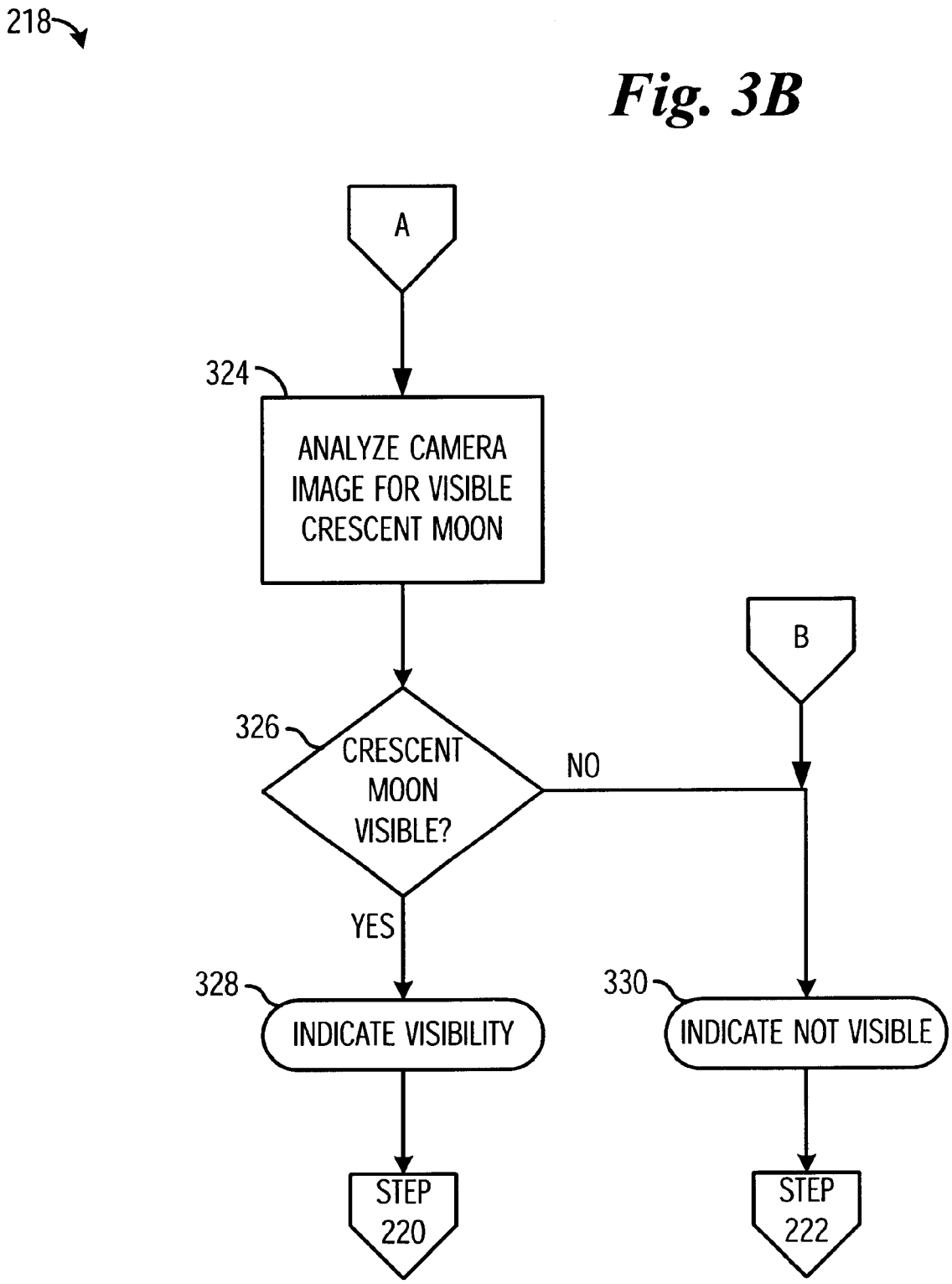

FIGS. 3A and 3B illustrate a method for determining the visibility of the lunar crescent, discussed above with respect to step 218 (FIG. 2), in accordance with a preferred embodiment of the present invention. Accordingly, upon a determination that the lunar crescent is in position for visibility at sunset in step 216 (FIG. 2), execution proceeds to step 218, the details of which are depicted by steps 314–334 of FIGS. 3A and 3B.

In step 314, the location for observation is retrieved. The location preferably comprises the latitude and longitude of the user 110, or other such reference system for the purpose of specifying the location of the user 110. Alternatively, the city, region, zip code, area code, county, country, state, continent, and the like, in which the user 110 is located may be used. The type of location may also vary depending on the type of access device 114 the user 110 is operating. For instance, the location of a desktop computer may be determined by the Internet Protocol (IP) address, and devices equipped with a Global Positioning System (GPS) typically provide latitude and longitude information. The process of retrieving location information of a device is well known in the art and will not be discussed in greater detail.

After determining the location for which an observation is desired, execution proceeds to step 316, wherein a determination is made whether a weather report is available. Preferably, a weather report is obtained from an online resource such as the METAR weather reports generally available from the National Oceanic and Atmospheric Administration (NOAA) web site (http://www.noaa.gov, last visited Feb. 23, 2001) and the World Meteorological Organization (WMO) web site (http://www.wmo.ch, last visited Feb. 23, 2001). The NOAA and WMO web sites, however, does not provide weather reports for every location.

If, in step 316, the weather report is available, then execution proceeds to step 318, wherein the weather report is obtained and parsed. Preferably, the weather report is provided electronically in a standardized format that may be parsed for the relevant conditions indicating the visibility of the lunar crescent, such as the sky coverage conditions. For example, the following report is a METAR weather report for the weather reporting station KAUS (Bergstrom Airport, Austin, Tex.) obtained at the web site http://weather.noaa.gov/weather/current/KAUS.html, (last visited Feb. 23, 2001):

KAUS 221853Z 02014KT 7SM OVC017 10/04 A3019 RMK AO2 SLP224 T01000044

An explanation of the terminology and the field codes may be retrieved from the WMO Manual No. 306, also available on-line at the web pages http://www.nws.noaa.gov/code.shtml and http://www.ofc.ca/METAR.htm. Preferably, for the purposes of the present invention, the sky coverage field is the field of interest. In the above example, the "OVC017" field represents that sky coverage comprises an overcast layer at 1700 feet.

After the weather report is obtained and parsed in step 318, execution proceeds to step 320, wherein a determination is made whether the weather report indicates that the conditions are favorable for viewing the lunar crescent. Preferably, a sky coverage rating of CLR or SKY (clear skies), FEW (few—more than 0 but less than ⅜ sky coverage), SCT (scattered—between ⅜ to ⅝ coverage), or BKN (broken—between ⅝ to b ⅞ coverage) results in a determination of favorable sky coverage conditions. Sky coverage of OVC (overcast—⅝ coverage), however, preferably results in a determination of unfavorable conditions.

If, in step 320, it is determined that the weather report indicates favorable weather conditions, then execution proceeds to step 322, wherein a determination is made whether a web observation is available for the location determined in step 314. Preferably, a camera is located in the relevant area, providing periodic views of the sky at the location the moon would be visible given no obstructions, such as clouds. The view of the camera is preferably accessible via the Network 112 by the device of the user 110. If it is determined that a web observation is available, then execution proceeds to step 324, wherein the user 110 is presented the image from the camera for the purpose of analyzing the image for the visibility of the lunar crescent by the user 110.

In step 326, a determination is made whether the lunar crescent is visible from the image analyzed in step 324. If it is determined that the lunar crescent is visible, an indication of visibility is set in step 328 and execution proceeds with step 220 (FIG. 2). If, however, a determination is made that the lunar crescent is not visible in step 326, an indication of not visible is set in step 330 and execution proceeds with step 222 (FIG. 2).

If it is determined in step 316 that a weather report is not available, or it is determined in step 320 that the weather report indicates unfavorable weather conditions, or it is determined in step 322 that a web observation is not available, then execution proceeds to step 332, wherein a determination is made whether to use a broader area. Preferably, a concise area, such as city or town, is used to specify the location for which a determination of the visibility of the lunar crescent is made. If the one of the conditions fails for the specific area, however, a broader area, such as a county, state, country, or continent, and/or the like, may be used. Preferably, the decision as to whether or not to use a broader area is made by the user 110.

Alternatively, a broader area may be used automatically and the user 110 notified of the use of the broader area.

If, in step 332, it is determined that a broader area may be used, execution proceeds to step 334, wherein the new location is determined. Thereafter, execution returns to step 316 to perform the processing as discussed above for the new location. If, however, a determination is made that a broader area may not be used in step 332, then execution proceeds to step 330, wherein an indication of not visible is set and execution proceeds with step 222 (FIG. 2).

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the language of the following claims.

What is claimed is:

1. A method of calculating the beginning of a new lunar month based on the visibility of a moon, the method comprising the steps of:

determining whether a web observation viewing the sky in the direction of the moon is available for a user;

upon a determination that the web observation is available, determining whether the moon is visible;

upon a determination that the moon is visible, indicating the beginning of a new lunar month; and upon a determination that the moon is not visible, indicating the continuation of a previous lunar month.

2. The method of claim 1, wherein the step of determining whether a web observation is available further comprises the step of determining the location of the user.

3. The method of claim 1, wherein the step of determining whether a web observation is available further comprises the step of determining the location of the user, the location being defined in terms of one or more of the latitude and longitude, a city, a state, county, a country, and a continent.

4. The method of claim 1, wherein the moon is visible as a lunar crescent.

5. The method of claim 1, wherein the step of determining whether the moon is visible further comprises the substeps of:

capturing an image of a camera providing the web observation; and examining the image of the camera for the presence of the moon.

6. A method of calculating the beginning of a new lunar month based on the visibility of a moon, the method comprising the steps of:

determining whether a weather report indicates suitable viewing conditions for a user for viewing the moon;

upon a determination that the weather conditions indicate suitable viewing conditions, determining whether a web observation viewing the sky in the direction of the moon is available for the user;

upon a determination that the web observation is available, determining whether the moon is visible;

upon a determination that the moon is visible, indicating a beginning of a new lunar month; and upon a determination that the moon is not visible, indicating a continuation of a previous lunar month.

7. The method of claim 6, wherein the step of determining whether a web observation is available further comprises the step of determining the location of the user.

8. The method of claim 6, wherein the step of determining whether a web observation is available further comprises the step of determining the location of the user, the location being defined in terms of one or more of the latitude and longitude, a city, a state, a county, a country, and a continent.

9. The method of claim 6, wherein the method further comprises the step of determining a broader area if at least one or both of the weather report and the web observation are unavailable.

10. The method of claim 6, wherein the step of determining whether the moon is visible further comprises the substeps of:

capturing an image of a camera providing the web observation; and examining the image of the camera for the presence of the moon.

11. The method of claim 6, wherein the weather report is provided from at least one of an on-line resource, National Oceanic and Atmospheric Administration, and a METAR weather report.

12. The method of claim 6, wherein the step of determining whether the moon is visible from the weather report further comprises the substeps of:

parsing the weather report for the conditions comprising the sky coverage; and determining whether the sky coverage indicates favorable weather conditions for viewing the moon.

13. A computer program product for calculating the beginning of a new lunar month based on the visibility of a moon, the computer program product having a medium with a computer program embodied thereon, the computer program comprising:

computer program code for determining whether a web observation viewing the sky in the direction of the moon is available for a user;

upon a determination that the web observation is available, computer program code for determining whether the moon is visible;

upon a determination that the moon is visible, computer program code for indicating a beginning of a new lunar month; and upon a determination that the moon is not visible, computer program code for indicating a continuation of a previous lunar month.

14. The computer program product of claim 13, wherein the computer program product further comprises computer program code for determining the location of the user.

15. The computer program product of claim 13, wherein the computer program product further comprises computer program code for determining the location of the user, the location being defined in terms of one or more of a latitude and longitude, a city, a state, a county, a country, and a continent.

16. The computer program product of claim 13, wherein the moon is visible as a lunar crescent.

17. The computer program product of claim 13, wherein the computer program code for determining whether the moon is visible further comprises:

computer program code for capturing an image of a camera providing the web observation; and computer program code for examining the image of the camera for the presence of the moon.

18. A computer program product for calculating the beginning of a new lunar month based on the visibility of a moon, the computer program product having a medium with a computer program embodied thereon, the computer program comprising:

computer program code for determining whether the weather conditions indicate suitable viewing conditions for a user viewing the moon;

upon a determination that the weather conditions indicate suitable viewing conditions, computer program code for determining whether a web observation viewing the sky in the direction of the moon is available for the location of the user;

upon a determination that the web observation is available, computer program code for determining whether the moon is visible;

upon a determination that the moon is visible, computer program code for indicating the beginning of a new lunar month; and upon a determination that the moon is not visible, computer program code for indicating the continuation of a previous lunar month.

19. The computer program product of claim 18, wherein the computer program product further comprises computer program code for determining the location of the user.

20. The computer program product of claim 18, wherein the computer program product further comprises computer program code for determining the location of the user, the location being defined in terms of one or more of a latitude and longitude, a city, a state, a county, a country, and a continent.

21. The computer program product of claim 18, wherein the computer program product further comprises computer program code for determining a broader area if at least one or both of the weather report and the web observation are unavailable.

22. The computer program product of claim 18, wherein the computer program code for determining whether the moon is visible further comprises:

computer program code for capturing an image of a camera providing the web observation; and computer program code for examining the image of the camera for the presence of the moon.

23. The computer program product of claim 18, wherein the weather report is provided from at least one of an on-line resource, National Oceanic and Atmospheric Administration, and a METAR weather report.

24. The computer program product of claim 18, wherein the computer program code for determining whether the moon is visible from the weather report further comprises:

computer program code for parsing the weather report for the conditions comprising the sky coverage; and computer program code for determining whether the sky coverage indicates favorable weather conditions for viewing the moon.

25. An apparatus for calculating the beginning of a new lunar month based on the visibility of a moon, the apparatus comprising:

means for determining whether a web observation viewing the sky in the direction of the moon is available for a user;

upon a determination that the web observation is available, means for determining whether the moon is visible;

upon a determination that the moon is visible, means for indicating the beginning of a new lunar month; and upon a determination that the moon is not visible, means for indicating the continuation of a previous lunar month.

26. The apparatus of claim 25, wherein the means for determining whether a web observation is available further comprises means for determining the location of the user.

27. The apparatus of claim 25, wherein the means for determining whether a web observation is available further comprises means for determining the location of the user, the location being defined in terms of one or more of the latitude and longitude, a city, a state, county, a country, and a continent.

28. The apparatus of claim 25, wherein the moon is visible as a lunar crescent.

29. The apparatus of claim 25, wherein the means for determining whether the moon is visible further comprises:

means for capturing an image of a camera providing the web observation; and means for examining the image of the camera for the presence of the moon.

30. An apparatus for calculating the beginning of a new lunar month based on the visibility of a moon, the apparatus comprising:

means for determining whether a weather report indicates suitable viewing conditions for a user for viewing the moon;

upon a determination that the weather conditions indicate suitable viewing conditions, means for determining whether a web observation viewing the sky in the direction of the moon is available for the user;

upon a determination that the web observation is available, means for determining whether the moon is visible;

upon a determination that the moon is visible, means for indicating a beginning of a new lunar month; and upon a determination that the moon is not visible, means for indicating a continuation of a previous lunar month.

31. The apparatus of claim 30, wherein the means for determining whether a web observation is available further comprises means for determining the location of the user.

32. The apparatus of claim 30, wherein the means for determining whether a web observation is available further comprises means for determining the location of the user, the location being defined in terms of one or more of the latitude and longitude, a city, a state, a county, a country, and a continent.

33. The apparatus of claim 30, wherein the apparatus further comprises means for determining a broader area if at least one or both of the weather report and the web observation are unavailable.

34. The apparatus of claim 30, wherein the means for determining whether the moon is visible further comprises:

means for capturing an image of a camera providing the web observation; and means for examining the image of the camera for the presence of the moon.

35. The apparatus of claim 30, wherein the weather report is provided from at least one of an on-line resource, National Oceanic and Atmospheric Administration, and a METAR weather report.

36. The apparatus of claim 30, wherein the means for determining whether the moon is visible from the weather report further comprises:

means for parsing the weather report for the conditions comprising the sky coverage; and means for determining whether the sky coverage indicates favorable weather conditions for viewing the moon.

* * * * *

Disclaimer 6,650,596—David Bruce Kumbyr; Samer Farid Najjar; Dalal Fathy Younis, all of Austin, TX. METHOD OF CALCULATING RELIGIOUS HIJRI CALENDAR. Patent dated November 18, 2003. Disclaimer filed February 2, 2004 by the assignee, International Business Machines.

Hereby disclaims all claims and dedicate to the Public the remaining term of said patent.

*(Official Gazette, June 15, 2004)*